United States Patent [19]

Ward et al.

[11] Patent Number: 4,573,518

[45] Date of Patent: Mar. 4, 1986

[54] CASTING METHOD AND APPARATUS

[75] Inventors: Richard Ward, Worsley; Kenneth Cooper, Wigan, both of England

[73] Assignee: Dobson Park Industries Plc., Nottingham, England

[21] Appl. No.: 608,278

[22] Filed: May 8, 1984

[30] Foreign Application Priority Data

May 19, 1983 [GB] United Kingdom ..... 8313862

[51] Int. Cl.[4] ..... B22D 29/00; B22D 33/04

[52] U.S. Cl. ..... 164/69.1; 164/130; 164/137; 164/330; 164/331; 164/342

[58] Field of Search ..... 164/324, 329, 330, 331, 164/339, 341, 342, 262, 137, 70.1, 69.1, 130, 133; 29/DIG. 20

[56] References Cited

U.S. PATENT DOCUMENTS 901,227 10/1903 Cleveland ..... 164/262
1,950,953 3/1934 Schrimgeour ..... 29/DIG. 20
3,604,497 9/1971 Slyvester ..... 164/342
4,301,856 11/1981 DiRosa ..... 164/342

FOREIGN PATENT DOCUMENTS 1604656 12/1981 United Kingdom .

*Primary Examiner*—Nicholas P. Godici
*Attorney, Agent, or Firm*—Murray, Whisenhunt and Ferguson

[57] ABSTRACT

Castings are produced by sandwiching a central mould part 10 between two outer mould parts 36, 38 during the casting process. The central mould part 10 is then transfered sequentially from between the outer mould parts 36, 38 and subsequently re-located between the outer mould parts in a vacant, relatively cool, and dry condition for the production of a further casting. In one embodiment a plurality of central mould parts are transferred sequentially from the outer mould parts to a removal station 45, a quenching station 50, and a drying station 70, before being returned to the central mould parts.

14 Claims, 7 Drawing Figures

CASTING METHOD AND APPARATUS

The invention relates to a casting method and apparatus, particularly but not exclusively, for the production of metal pre-forms, usually of steel, for subsequent working and shaping, for example by a forging process. By manufacturing an appropriately shaped pre-form one can reduce the time and energy required for subsequent working, for example during a forging process, and one can also reduce the waste or scrap material which often results from a conventional forging process.

In the past pre-forms have been made by stamping or cutting from bar stock a blank or pre-form of the appropriate shape and material. However bar stock is relatively expensive and stamping or cutting processes produce wastage in the form of scrap. It would be desirable to be able to cast the pre-forms, for example using low grade scrap materials as a basis. We therefore developed a casting method and apparatus and one such method and apparatus is described in our GB Patent Specification No. 1604656.

The present invention seeks to provide a method and apparatus which have a number of advantages over the method and apparatus described in our GB Patent Specification No. 1604656.

According to one aspect of the present invention, there is provided a method of producing castings by sandwiching a central plate-like mould part between the two outer mould parts during the casting process, in which the central mould part is then transferred sequentially from between the outer mould parts through a casting removal station, a central mould part quenching station and a central mould part drying station before it is re-located between the two outer mould parts for the production of a further casting. The quenching and drying of the central mould part enables it to be re-used rapidly, thus increasing the rate of production of the castings.

The specification of the material used for the casting can be readily adjusted. The basic low grade material may be up-graded by the addition of elements such as mangenese and chromium whilst the molten material is still in a furnace. Samples taken from the furnace can be cast and analysed and the specification of the molten metal can be adjusted in the furnace prior to the actual casting process.

The outer mould parts may be continually cooled, for example by pumping a coolant such as water through cooling ducts in the mould parts. Since however the outer mould parts are only in contact with the molten metal for a brief period, during the formation of a surface skin, the tendency to reach elevated temperatures is not as great as that experienced by the central plate-like mould part.

In many cases the castings are manufactured for use in a subsequent hot working process, for example forging as mentioned above, and it is preferred that the equipment for the said hot working process is positioned adjacent to the casting removal station to utilise the residual heat in the castings. This may reduce a manufacturing cycle by decreasing the number of operations involved, particularly, but not exclusively, the heating or re-heating processes to maintain the castings at a forging temperature.

At least one hole may be produced in a casting during the casting process.

The central mould part may be for use in the production of a casting having a predetermined shape, the central mould part having a mould cavity of substantially twice the size of the desired casting, such as to produce a preliminary casting comprising two of the desired castings, integrally joined together, one being a mirror image of the other, and the preliminary casting subsequently being sheared in half, for example by means of a stamping or cutting process, to separate the two desired castings.

If desired more than two items may be manufactured from one casting.

Preferably the preliminary casting is sheared whilst still at a high temperature and hence relatively soft.

The invention includes apparatus for producing castings, the apparatus comprising a central plate-like mould part, two outer mould parts between which the central mould part is sandwiched during the casting process, a casting removal station, a central mould part quenching station, a central mould part drying station and means for moving the central mould part sequentially from between the outer mould parts through the said removal, quenching and drying stations before re-locating it between the two outer mould parts for the production of a further casting.

Preferably the apparatus has means to produce at least one hole in a casting during the casting process. For example a hole may be produced by allowing a projection on one outer mould part to contact the other outer mould part, through the central mould part.

Because of the need to seal the three parts of the mould together during the casting process, the projection may comprise a withdrawable core.

The core may be resiliently loaded into the projected position, there being means for withdrawing the core hydraulically, pneumatically or other means upon solidification of the casting. Thus the core may make complete peripheral contact with the casting but in no way inhibits the sandwich of the contacting mould parts being completed so as to retain the molten metal on pouring and filling of the mould.

The central mould part may have a filling opening in its upper edge, the bottom portion of the central mould part being of substantially smaller volume than the central portion of the central mould part, to increase the tendency for the molten metal first entering the mould part to solidify quickly and hence reduce the tendency for the molten metal to weld on to the mould part.

In other words the design of the central plate-like mould part is such as to achieve the maximum freezing effect on the contact surfaces of the molten metal thus greatly reducing the tendency for the molten metal to weld on to the mould parts.

The mould parts may also be designed to reduce casting voids normally resulting from the contraction on cooling and any such voids may be localised for removal by a cropping process prior to the subsequent working of the casting. In this way the maximum useable size of casting may be produced, and wastage in both the casting and subsequent operations may be minimal.

The central mould part may have a mould cavity substantially of a size which is a multiple of the size of the desired casting.

Where the apparatus is to be used for the production of generally T-shaped castings, the central mould part preferably has a mould cavity generally in the form of a cross.

The leg of each T may be wider at the foot of the T than at the top.

When designing the central mould part, it is highly desirable to have a slot, access or gate in the upper edge of the mould part to facilitate unrestricted pouring of the molten metal into the mould, the size and proportions of the slot, access or gate being such as to provide adequate access for the molten metal, and free escape for any air or gases which would otherwise be trapped in the mould thus resulting in unsound castings.

Preferably the central mould part has a filling opening with a stepped formation on that side of the opening which tends to be struck first by molten metal being poured into the opening, the stepped formation reducing problems associated with wear and welding on.

Means may be provided for modifying the constituent parts of the composite mould thus making it possible to produce castings of varying thickness but identical profile.

Where it is desired to produce castings having localised thicker or thinner parts, the appropriate surfaces of the outer mould parts may be made concave or convex or both, to produce the pre-requisite shape of casting. It is important however that the mating faces of the mould parts be parallel in order to provide adequate sealing when the three parts of the mould are in contact.

Certain of the features described above may be of useful application in their own right and the invention includes those features per se. These features include the following:

The carrying out of subsequent hot working processes adjacent to a casting removal station to utilise residual heat in the castings.

The production of at least one hole in a casting during a casting process employing a central plate-like mould part.

The production of a preliminary casting using a central plate-like mould part, for subsequent separation into two more separate castings, for example by a shearing process.

The provision of a central mould part having a bottom portion of substantially smaller volume than a central portion, to increase the tendency for the molten metal first entering the mould part to solidify quickly and hence reduce the tendency for the molten metal to weld on to the mould part.

The provision of a central mould part having a filling opening with a stepped formation on that side of the opening which tends to be struck first by molten material being poured into the opening, the stepped formation reducing problems associated with wear and welding on.

By way of example, specific embodiments of the invention will now be described, with reference to the accompanying drawings, in which:

Figure 1:
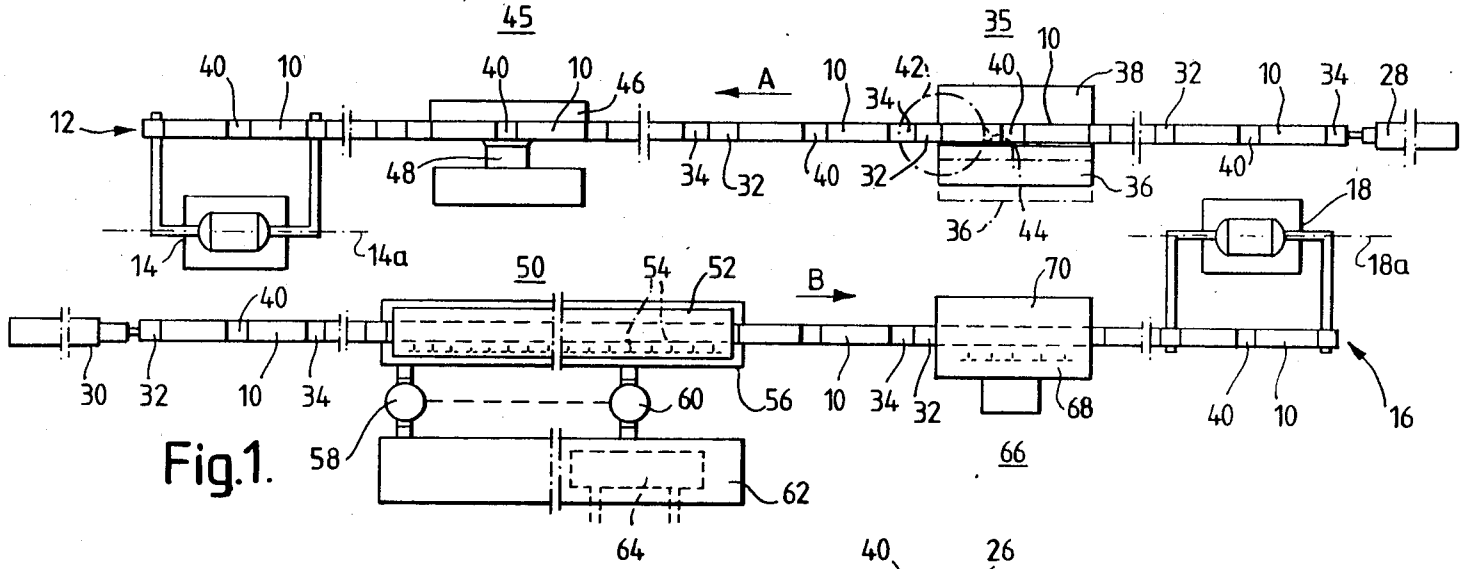
FIG. 1 is a schematic plan view of a cyclic casting process and apparatus according to the invention.
Figure 2:
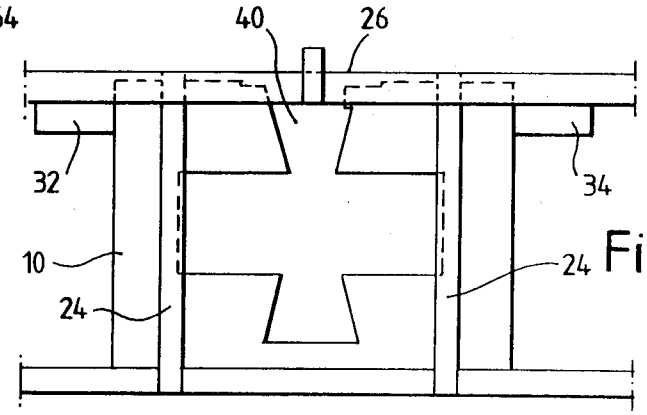
FIG. 2 is a side view of part of the apparatus shown in FIG. 1.
Figure 3:
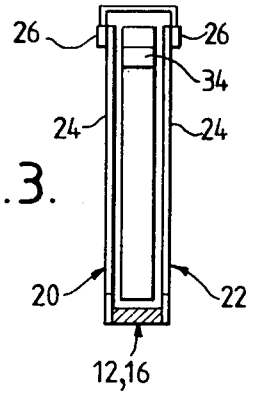
FIG. 3 is an end view of the part of the apparatus shown in FIG. 2.

The apparatus shown in FIGS. 1, 2 and 3 comprises two parallel track parts, 12 and 16. Each track part has sides 20, 22 of openwork form, comprising, in this embodiment, posts 24 projecting from rails 26. Central mould parts 10 can be moved along track part 12 in the direction of arrow A, can be transferred at 14 to track part 16, can then be moved along track part 16 in the direction of arrow B, and can finally be transferred back to track part 12 at 18. The mould parts travel through work stations and the openwork form of the track parts facilitate access to the mould parts at the work stations and allow cooling of the central mould parts and castings therein.

Movement of the central mould parts 10 along each track is in an indexed manner to provide equal successive movements of appropriate length such as to locate successive central mould parts at each work station. The indexed movement is brought about by fluid pressure operated rams 28, 30 of appropriate stroke, their operation being synchronised or alternatingly co-ordinated to achieve the required movement of the central mould parts 10.

The central mould parts 10 are provided with side extensions 32, 34. The side extension of one mould part abuts the side extension of the adjacent mould part so as to space the central mould parts by the desired amount. The side extensions 32, 34 are also used to transfer the mould parts from track to track. At each of the locations 14 and 18 there is a device rotatable about an axis 14*a*, 18*a* respectively. Each device has a pair of arms each terminating in a hook member. In FIG. 1 the arms of the device at 14 are positioned with their hooked ends engaging under the side extensions of the left-hand central mould part 10. To transfer the left-hand central mould part 10 to the track 16 the device is rotated about axis 14*a* and the arms swing upwardly through an arc of 180°. The hooked ends of the arms are pivotable on the arms so that the side extensions of the central mould part remain securely within the hooked ends until the mould part is deposited on the track 16. The device at 18 can be similarly operated to transfer a mould part from track 16 to track 12.

The movement of the double arm transfer mechanisms at 14 and 18 is suitably co-ordinated with the indexing movement of the rams 28 and 30 so that a central mould part is not newly deposited on a track until the appropriate ram has been actuated to push the preceding mould part out of the way.

The side extensions 32 and 34 also usefully serve to ensure upright location of the central mould parts 10 at each work station.

The first work station along the track part 12 in the direction of arrow A is a pouring or casting station 35 shown as having two water cooled outer mould parts 36, 38, at least one of which, in this case part 36, is movable towards and away from the track part 12 between a first position where a central mould part is closely sandwiched between the outer mould parts, as shown in full lines, and a second position in which a central mould part is freely movable, as shown in dotted lines.

Gaps in the upper edge of the central mould parts are indicated at 40 and these will, after each indexing movement along the track part 12, be accurately positioned relative to a crucible, shown in dotted lines at 42, above the mould parts 36, 38. The crucible is associated with a suitable mechanism for tilting it about an axis transversely of the track part 12, with controlled stability of a pouring lip 44 of the crucible, such that molten metal will be readily directed into a mould through the associated gap 40.

The next, and in fact only, work station shown along track part 12 is a casting unloading station 45 where a central mould part containing a cast pre-form engages against suitable anvil-like abutment means 46 while the pre-form is ejected by a powered extensible striker or pusher 48.

After transfer to track part 16, the now empty central mould parts will, in their passage therealong, encounter a length of track comprising a cooling station 50 where they pass under a tunnel section 52 within which cooling water is applied to them directly by sprayheads 54 or other suitable means. A water collection trough below the track part 16 is indicated at 56 and a recirculation type water supply is indicated, by way of example only, and comprising pumps 58, 60 and a reservoir 62. A temperature controlling heat exchanger is also indicated in dotted lines at 64.

After leaving the cooling station 50, the central mould parts go through a length of track comprising a drying station 66 which employs a pressure air jet system 68, preferably within a shroud 70.

The presence of standing water on the central mould parts 10 between the cooling and drying stages, and without any steaming, gives a reasonably secure indication to an operator that the central mould parts 10 are substantially below 100° C. before they reach the casting/pouring station 35.

Figure 4:
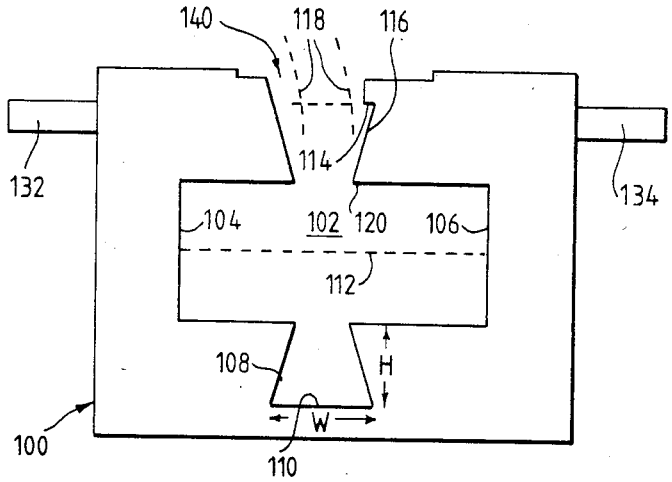
FIG. 4 is a more detailed side view of one central mould part of the apparatus.

Turning now to FIG. 4, one of the central mould parts is shown in more detail at 100, having side extensions 132, 134, and a pouring entry or gap 140 leading to its slot 102. That slot is shown having a central region, extending between sides 104 and 106, which is wider than a bottom portion 108 positioned immediately under the pouring entry 140. It is into this bottom portion 108 that molten metal will strike first during casting and its width W and height H are chosen at least partly to ensure that the mould fills at a rate and to an extent which contributes to avoiding, or at least minimising, the problem of molten metal welding on to the bottom edge 110. Otherwise, of course, the bottom portion 108 is sized and shaped to suit the casting required. In this particular example, the requirement is to produce two generally T-shaped pre-forms, by eventually shearing the preliminary casting along the dotted line 112.

The central mould part 100 is also shown with a stepped formation 114 at its pouring entry or gap 140, lying to one side 116 thereof. The path which will be taken by molten metal from the crucible 42 is indicated by dotted lines 118. The metal is generally poured from one side of the mouth 140 towards the side 116, past the stepped formation 114. The stepped formation 114 assists in avoiding welding on and wear problems which might otherwise be experienced at the corner 120.

A casting from the slot 102 is readily unloaded whilst still very hot, and is then sheared along line 112, and also cropped at a position corresponding to the bottom of the step 114 of the central mould part 100 to remove the extreme upper portion of the casting which will contain slag or contraction voids. Thus each central mould part will produce two substantially identical, generally T-shaped, pre-forms.

Figure 5:
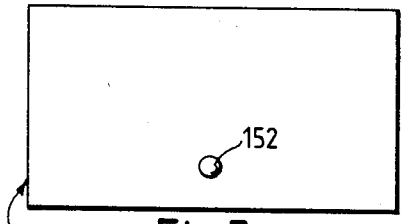
FIG. 5 is a side view of an alternative embodiment of outer mould parts.

For some purposes it may be desirable to form holes or cavities in the pre-forms, either for subsequent working of the pre-form or as a means of reducing such working. FIG. 5 shows the interior or cast engaging face of an outer mould part 150 which may conveniently replace that referenced 38 in FIG. 1. i.e. the part 150 may comprise the relatively stationary mould part at the casting station.

Figure 6:
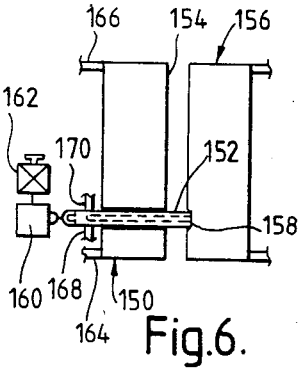
FIG. 6 is an end view, partly in section, of the alternative embodiment of outer mould parts shown in FIG. 5.

FIG. 6 shows a side view of the outer mould part 150, partly in section. A cylindrical member 152 is extensible and retractable between a first position in which it is flush with or within the cast engaging face 154 of the outer mould part 150, and a second position as shown in which it projects from the cast engaging surface, extends right through the central mould part (not shown) and engages with a slight depression 158 in the second of the outer mould parts 156.

A ram is indicated at 160 for extending and retracting the member 152 and the ram is conveniently associated with a pre-settable timer 162 that can be actuated at initiation of pouring to effect automatic retraction after an appropriate time interval. This simplifies the operators duties, though it has been found to be generally satisfactory to simply retract at the end of pouring so that a "one shot" extension switch is suitable, i.e. with automatic return when the switch is released.

The retraction and extension of the cylindrical member 152 is such that it can in no way inhibit the movement of the central mould part 10 from the casting station, and an alternative location on the outer mould part combines the withdrawal of the cylindrical member 152 from the casting at the same time as the central mould part is released from the outer mould parts.

Connections are indicated at 164, 166, for flow and return of a cooling medium to the outer mould part 150, with similar provisions for part 156. Coolant flow and return 168, 170 are also shown for the member 152, specifically being indicated as of co-axial tube constructions.

Figure 7:
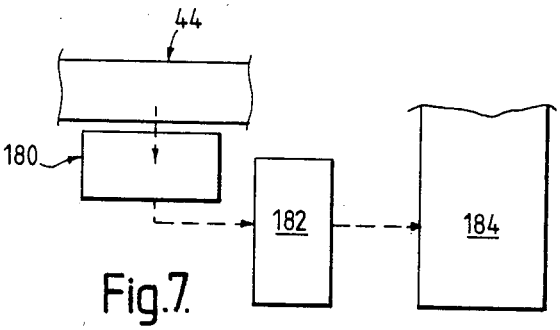
FIG. 7 is a schematic diagram in block form showing how the casting process may be associated with subsequent processes.

FIG. 7 indicates in block diagram form how the casting process may be combined with subsequent operations. For example a collector 180 may be positioned adjacent to the unloading station 45 to receive the unloaded cast pre-forms. A cropper/shearer 182 is provided for trimming or sizing the pre-forms and shearing the preliminary casting to provide two pre-forms from each casting. Forging plant is provided at 184 for subsequent working of the pre-forms to make finished products involving dimensional reduction of the pre-forms in at least one direction, normally at least flattening, and often also curving and/or bending, before the pre-forms have had a chance to cool after the casting process.

The invention is not restricted to the details of the foregoing embodiments.

For instance, dimensions, shapes, and pouring temperatures may be altered to manufacture pre-forms of any other desired shape.

Although the above embodiments specifically are concerned with the manufacture of pre-forms which are to be shaped in a manner to reduce excessive subsequent working and to reduce waste, the invention could equally be used to manufacture a casting comprising a billet or bar of a desired material specification and temperature for subsequent working. Where the casting does comprise a billet from which several blanks are prepared for subsequent forging, it may be necessary to re-heat such blanks to a uniform forging temperature in a furnace from which they will be immediately transferred to a conventional forging plant.

The movement of the central mould parts may be controlled by an operator who may stop the movement intermittently, in accordance with the skin freezing time of the casting. If the skin is not allowed to cool for long enough, the casting disintegrates on removal. If the casting is allowed to cool for too long, the casting may have to be reheated for subsequent working.

We claim:

1. A method of making T-shaped products comprising providing a central mould part having a top, a bottom, ends and sides, and a mould cavity therein extending from one side to the other, the mould cavity being of a generally cross configuration having a central part and two arms extending therefrom, with the central part of the cavity being of substantially greater volume than either of the arms of the cavity, sandwiching the sides of the central mould part between two mating outer mould parts to form a cavity closed except for a filling opening at the top of the central mould part leading to the arm of the cavity nearest the top of the part, casting molten metal into the cavity through the filling opening with the molten metal first filling the lower arm of the mould cavity, cooling the metal to at least partial solidification, removing the central mould part from between the outer mould parts and removing the casting from the central mould part out of a side thereof, shearing the casting in half to produce two similar T-shaped products, and quenching and drying the central mould part prior to reuse in the production of a further casting.

2. Method of claim 1, wherein each central mould part has a spacer extending from each end thereof, with the castings being made sequentially in a series of moulds which are arranged in end-to-end relationship, with the spacers of one mould abutting the corresponding spacers of the mould on either end thereof.

3. Method of claim 2, wherein said central mould parts are dried by jets of air.

4. Method of claim 1, wherein at least one arm of the casting has a foot and a top, with the foot being furthest removed from the central part of the casting, and the top being closest to the central part of the casting, with the foot being wider than the top of the arm.

5. Method of claim 1, wherein the casting is removed from the central mould part, the central part is quenched and the central mould part is dried sequentially after the molten metal casting step.

6. Method of claim 1, wherein the T-shaped products are used in a subsequent hot working process, and the equipment for said hot working process is positioned adjacent to the casting removal location to utilize the residual heat in the castings.

7. Method as claimed in claim 1, including the additional step of cooling the outer mould parts by a circulating fluid at least during the casting solidification.

8. Method of claim 1, wherein the two T-shaped products produced by shearing a given casting in half are at least substantially identical.

9. Metal casting system comprising:

a moulding station;

a casting removal station;

two spaced apart outer mould parts positioned at said moulding station, each said outer mould part having a mould surface defining face, the two mould surface defining faces facing one another;

at least one central plate like mould part having side faces and an upper edge, a mould cavity extending laterally through the central mould part from one side face to the other, and an access port for molten material extending from said upper edge downwardly to said mould cavity, said mould cavity being shaped substantially like a cross having a central portion and two arms projecting therefrom, the volume of each said arm being less than the volume of said central portion and said access port opening into the free end of one of said arms;

means for moving said outer mould parts relatively towards one another to sandwich said central mould part therebetween with said mould surface defining faces respectively abutting said side faces of said central mould part to close said mould cavity laterally, said access port remaining open to receive molten material for forming a cross-shaped casting within said mould cavity;

means for moving said central mould part away from said outer mould parts to said casting removal station when said moulten material has at least partially hardened;

removal means positioned at said casting removal station for removing said cross-shaped casting out of said mould cavity in a direction extending laterally of said central mould part; and means for cutting said cross-shaped casting in half to provide two substantially identical T-shaped castings, and means for quenching and drying the central mould port after removal of said casting therefrom.

10. System of claim 9, wherein each central mould part has a spacer means extending from each end thereof for cooperating with a mating spacer extending from the end of an adjacent mould part assembly to maintain a predetermined spacing between the respective central mould parts.

11. System of claim 9, wherein said drying means are air jets.

12. System of claim 9, wherein at least one arm of the mould cavity has a foot and a top, the foot being furthest removed from the central portion of the mould cavity, and the top being closest to the central portion of the mould cavity, with the foot being wider than the top of the arm.

13. System of claim 9, wherein the outer mould parts have planar surfaces.

14. System of claim 9, additionally including a hot working process station for subsequent hot working of the T-shaped castings, said hot working process station being positioned adjacent to the means for cutting the cross-shaped casting in half to utilize the residual heat in the castings.

* * * * *